US006731260B2

(12) United States Patent
Jinno et al.

(10) Patent No.: US 6,731,260 B2
(45) **Date of Patent: *May 4, 2004**

(54) DISPLAY DEVICE

(75) Inventors: Yushi Jinno, Gifu (JP); Kyoko Hirai, Hashima (JP)

(73) Assignee: Sanyo Electric Co., Ltd., Osaka (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/169,460

(22) Filed: Oct. 9, 1998

(65) Prior Publication Data

US 2001/0040547 A1 Nov. 15, 2001

(30) Foreign Application Priority Data

Oct. 13, 1997 (JP) ..... 9-279018

(51) Int. Cl.[7] ..... G09G 5/00

(52) U.S. Cl. ..... 345/90; 345/87; 345/204; 345/205; 345/206

(58) Field of Search ..... 345/87, 90, 204, 345/205, 206

(56) References Cited

U.S. PATENT DOCUMENTS 4,578,672 A * 3/1986 Oota et al. ..... 345/88
5,517,208 A * 5/1996 Mori et al. ..... 345/87
5,675,354 A * 10/1997 Katakura et al. ..... 345/97
5,677,706 A * 10/1997 Inoue et al. ..... 345/100
5,805,117 A * 9/1998 Mazurek et al. ..... 345/1

OTHER PUBLICATIONS

Japanese Patent Laid–Open Publication No. Hei 8–220560, published Aug. 30, 1996.
Japanese Patent Laid–Open Publication No. Hei 9–171192, published Jun. 30, 1997.
Microfilm of Japanese Utility Model Application No. Hei 2–45085 (Japanese Utility Model Laid–Open Publication No. Hei 4–6030).
Microfilm of Japanese Utility Model Application No. Hei 2–18227 (Japanese Utility Model Laid–Open Publication No. Hei 3–110486.
Japanese Patent Laid–Open Publication No. Hei 6–138488, published May 20, 1994.
Japanese Patent Laid–Open Publication No. Hei 6–258650, published Sep. 16, 1994.
Japanese Patent Laid–Open Publication No. Hei 8–328034, published Dec. 13, 1996.
Japanese Patent Laid–Open Publication No. Hei 6–202160, published Apr. 20, 1994.

* cited by examiner

*Primary Examiner*—Bipin Shalwala
*Assistant Examiner*—Vincent E. Kovalick
(74) *Attorney, Agent, or Firm*—Hogan & Hartson, LLP

(57) ABSTRACT

A sealing material is formed to cover a drain driver comprising a horizontal shift register and a sampling portion and its edge lines are linear on the horizontal shift register. Operation characteristics of TFT elements just below the sealing material are changed and are different from those of TFT elements of the area not below the sealing material. However, operation characteristics do not differ between phases of the shift register, and adverse effects for display can be prevented.

27 Claims, 12 Drawing Sheets

DISPLAY DEVICE

BACKGROUND OF THE INVENTION a) Field of the Invention

The invention relates to a display device using an optical member such as liquid crystal, and more particularly to a display device having a drive circuit therein.

b) Description of the Related Art

A liquid crystal display devices (LCD) formed by adhering a pair of plates having predetermined electrode wiring mutually with a small gap therebetween and charging a liquid crystal into the gap to form a capacitor having the liquid crystal as a dielectric layer to form pixels, or an organic electroluminescence (EL) display device using organic EL capable of controlling an amount of emission by a quantity of electric current are used extensively as displays in the fields of OA equipment and AV equipment in view of advantages of being compact, thin, and low in power consumption. Especially, an active matrix LCD, which is formed with a thin film transistor (TFT) connected as a switching element to each pixel capacitor in order to control writing and retention of a display signal voltage, can display high resolution images are now standard.

FIG. 11 is a plan view showing the entire LCD, in which reference numeral 1 is a TFT substrate positioned at the back of the drawing, 2 is a counter substrate positioned toward this side of the drawing, and 3 is an edge sealing material for adhering the substrate 1 with the substrate 2 and made of a thermosetting adhesive agent such as an epoxy resin or a resin which is cured by irradiation of UV light. A small gap is formed between the TFT substrate 1 and the counter substrate 2 by a spacer (not shown), and the sealing material 3 is partly cut away to form an injection hole 31. The liquid crystal is injected into the gap through the injection hole 31, and the injection hole 31 is tightly sealed with a sealing material 32.

The TFT substrate 1 has TFT formed using polycrystalline silicon (p-Si) as a channel layer on the substrate. The substrate 1 has thereon a display area 4, which has a plurality of gate lines GL and drain lines DL arranged to intersect to one another and pixel electrodes PX formed at the intersections and connected to pixel TFTs SE to form one of pixel capacitors, a gate driver 5 formed around the display area 4 to supply a scanning signal to the pixel TFTs SE, a drain driver 6 which mainly comprises a bidirectional shift register and an analog switch and supplies a display signal voltage to the pixel TFTs SE in synchronization with scanning of the gate driver 5, and a control circuit 7 which changes the shifting direction of the shift register to switch the operation directions of the drivers 5, 6. These drivers 5, 6 are formed of p-Si TFTs having the same configuration as the display area 4. Since the p-Si TFT has a sufficient operation speed, it can configure not only the pixel TFTs SE but also the peripheral drivers for driving them. Thus, a driver built-in LCD having such drivers incorporated into the display panel can be provided. Such TFTs are covered with a flattening insulating film of acrylic resin, SOG (spin on glass), BPSG (Boro-Phospho Silicate Glass) or the like. The pixel electrodes PX are formed on the flattening insulating film in the display area 4, and connected to the pixel TFTs SE through contact holes formed in the flattening insulating film. Reference numeral 8 denotes signal-input terminals of such drivers.

The counter substrate 2 has a common electrode 9, which forms the other of the pixel capacitors, formed entirely to correspond with the display area 4. Although FIG. 11 shows circuitry on the front side of the substrate 2, the circuitry may be formed on the back side to oppose the TFT substrate 1. The pixel capacitors are formed to comprise the liquid crystal and the common electrode 9 divided by the pixel electrodes. The common electrode 9 is partly extended to a corner of the substrate 2 to form a second counter electrode (common electrode) connection terminal 91. The TFT substrate 1 has a counter electrode signal input terminal 81 for the common electrode 9. The counter electrode signal input terminal 81 is routed to a first counter electrode connection terminal 83 formed on an area corresponding (oppose) to the counter electrode connection terminal 91 by a route line 82. And, the first and second counter electrode connection terminals 83, 91 are mutually adhered with a conductive adhesive agent 92.

FIG. 12 is a partly enlarged plan view of an LCD. Gate driver 5 comprises a vertical shift register 51 and a buffer portion 52 which are formed along the vertical side in the drawing. Drain driver 6 comprises a horizontal shift register 61 formed along the horizontal side in the drawing and a sampling portion 62 consisting of analog switches corresponding to respective columns. The analog switches are controlled to turn on/off by the respective output phases of the horizontal shift register 61 to sample a display signal voltage from the original image signal which is externally supplied in synchronization with a dot cycle allocated to each column in each horizontal cycle and output to each column.

The epoxy resin or UV resin used for the sealing material 3 may contain water content which survives after drying when applied, atmosphere water content, impurity ions, or the like, and the flattening insulating film as the base of the sealing material 3 may be polarized. Thus, TFTs below the flattening insulating film cause a back channel effect, and an operation threshold voltage varies. Therefore, in the configuration that the sealing material 3 is formed to cover the areas of the gate driver 5 and the drain driver 6 as shown in FIG. 11, a logical circuit such as the shift register is located just below the sealing material 3. When the operation characteristics of the respective TFT elements are changed, malfunction may occur, possibly resulting in equipment failure.

Further, even if the characteristics of the TFT elements are only slightly changed, when the curved portion of the outer edge line of the sealing material 3 is formed to locate on the drain driver 6 as shown in FIG. 12, the respective output phases of the drain driver 6 differ in operation between those in the area just below the sealing material 3 and those in the area not below the sealing material 3. As a result, the display characteristics are different between the columns of the display area 4 corresponding to the output phases below the sealing material 3 and those in the area other than the sealing material 3 on the side of the gate driver 5, the display characteristics also differ between the rows with the corresponding phases of the gate driver 5 just below the sealing material 3 and those in the area not below the sealing material 3. In the drawing, the shaded (with lines rising toward the right side) area in the display area 4 has the corresponding shift register 51 or 61 of the gate driver 5 or the drain driver 6 in the area just below the sealing material 3, and the area not shaded has the corresponding shift registers 51, 61 in the area other than the sealing material 3. The area not shaded is free from being changed the display characteristics, while the hatched area has the display characteristics varied. Thus, the shaded area is seen different from the other area. A large stress is applied to the outside edge of the curved portion of the sealing material 3 to affect on the characteristics of the TFT elements positioned below it. Therefore, the area having the phases of the corresponding drivers 5, 6 on the curved portion of the sealing material 3 is seen different from the other area. Thus, the mixed presence of the areas with different display characteristics in the display area 4 results in degrading the display quality.

If the control circuit 7 is defective in operation, the operating directions of the drivers 5, 6 cannot be changed, and general versatility of the LCD having drivers therein is degraded.

SUMMARY OF THE INVENTION

In the invention, an adhesive agent is applied so that its edge lines extend linearly in a direction of the longitudinal sides of the drive circuit area.

Accordingly, the phases in the drive circuit are prevented from being influenced differently by the adhesive agent, and the mixed presence of areas having different displays in the display area can be prevented.

The adhesive agent may preferably be formed to detour around the control circuit area so that the operation directions of the drive circuit are switched suitably.

The adhesive agent may also be preferably formed to detour around the drive circuit area and/or the control circuit area so that the drive circuit and the control circuit are prevented from being made defective due to influence of the adhesive agent.

It may also be preferable that the drive circuit comprises a drive signal output portion based on the output from at least the shift register and each output phase of the shift register, and the adhesive agent is formed to detour around the shift register area and/or the control circuit area.

Accordingly, the shift register and the control circuit are prevented from being defective in operation due to an influence of the adhesive agent.

The adhesive agent may further preferably be formed to fully cover the shift register area or the drive signal output portion.

In this way, an influence applied by the adhesive agent is equal to all the phases in the shift register, and the operation characteristics of all the phases are uniform. Therefore, the mixed presence of areas having different displays in the display area can be prevented.

The adhesive agent may also preferably fully cover the drive circuit area. Influences applied to all the phases in the drive circuit by the adhesive agent are then equal, and the operation characteristics of all the phases are uniform. Therefore, the mixed presence of areas with different displays in the display area can be prevented.

As described above, in the display device with the drive circuit built in according to the invention, the drive circuit is prevented from being made defective by the adhesive agent used to adhere a pair of opposed electrode substrates, and high quality displays can be produced.

DETAILED DESCRIPTION OF THE PREFERRED EMBODIMENTS

Figure 1:
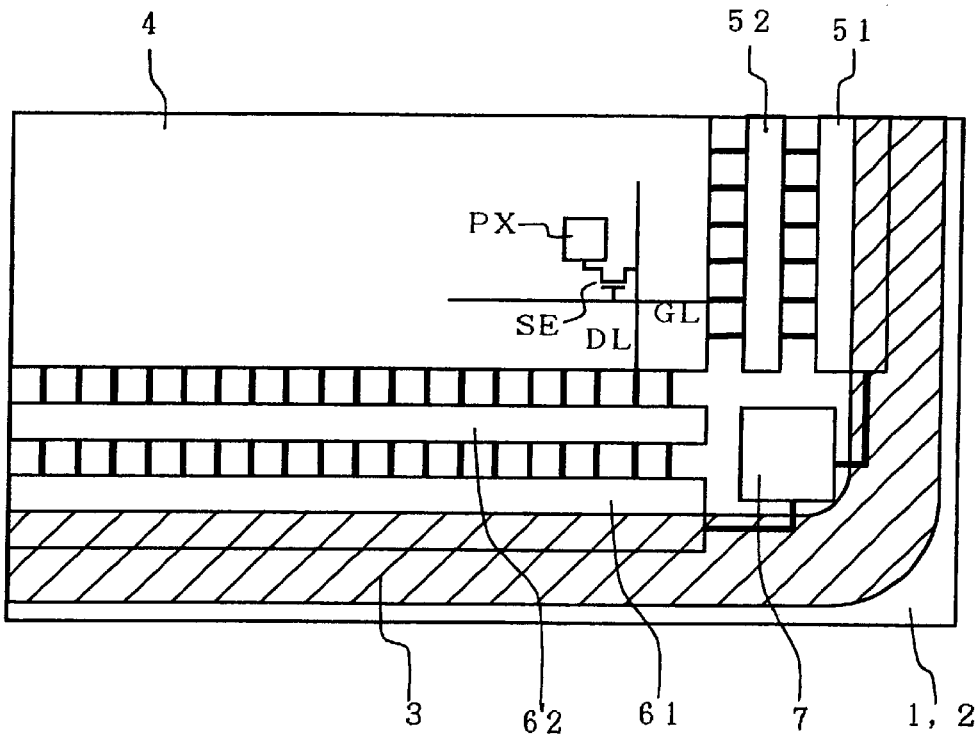
FIG. 1 is a partial plan view of a liquid crystal display device according to a first embodiment of the present invention.

FIG. 1 is a partial plan view of the liquid crystal display device according to a first embodiment of the present invention. Reference numerals 1 and 2 are a TFT substrate having p-Si TFT and a counter substrate, the edges of which are aligned two-dimensionally. The TFT substrate 1 includes a display area 4 on which a plurality of gate lines (GL) and drain lines (DL) are formed to alternately intersect. At the intersections, pixel electrodes PX, which are connected to pixel TFTs SE, SE and form one of pixel capacitors, are arranged in a matrix. A gate driver, which comprises a bidirectional vertical shift register 51 and a buffer portion 52 as its output, and a drain driver, which comprises a bidirectional horizontal shift register 61 and a sampling portion 62 as its output, are formed on the periphery of the display area 4. A control circuit 7 is also formed on the periphery of the display area 4 to changeover the shifting directions of the shift registers 51, 61 to reversely change the operation directions of the drivers. The counter substrate 2 also includes a common electrode which is not shown.

Figure 2:
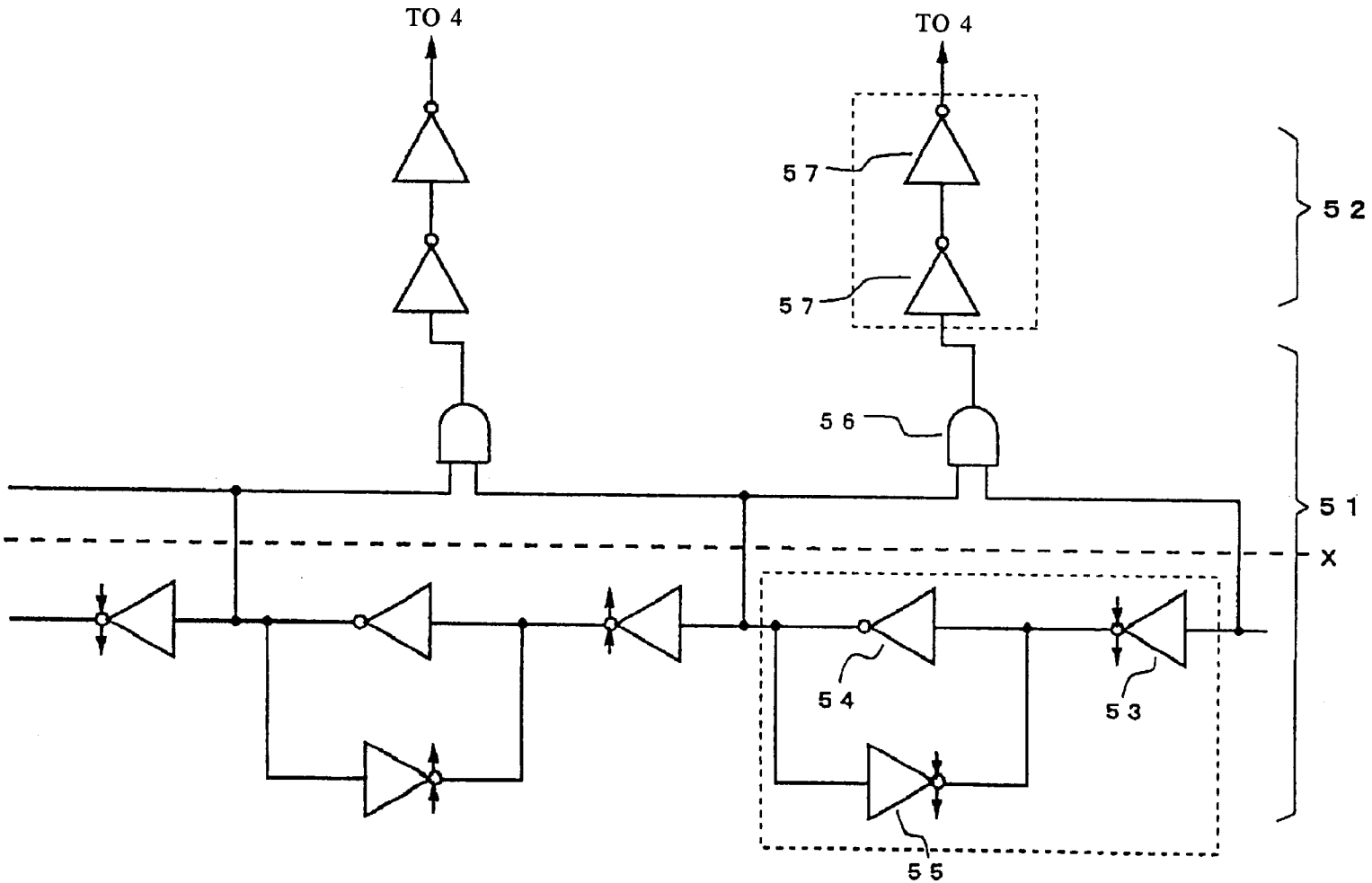
FIG. 2 is a partial equivalent circuit diagram of the liquid crystal display device according to the first embodiment.

FIG. 2 is an equivalent circuit diagram of the gate driver (the shift register 51 and the buffer portion 52). The lower half is the vertical shift register 51, and the upper half is the output buffer 52. Respective phases of the vertical shift register 51 comprise a first clocked inverter 53, an inverter 54, and a second clocked inverter 55 connected in parallel to the inverter 54 in an opposite direction. Output from the individual neighboring phase is output after being ANDed by an AND gate 56. Output from each output phase of the vertical shift registers 51 is output as a scanning signal having a desired amplitude to the gate line GL of a corresponding row on the display area 4 through the buffer 52 which comprises a plurality of inverters 57 connected in series and entered into the gate of each pixel electrode SE of the same line.

Figure 3:
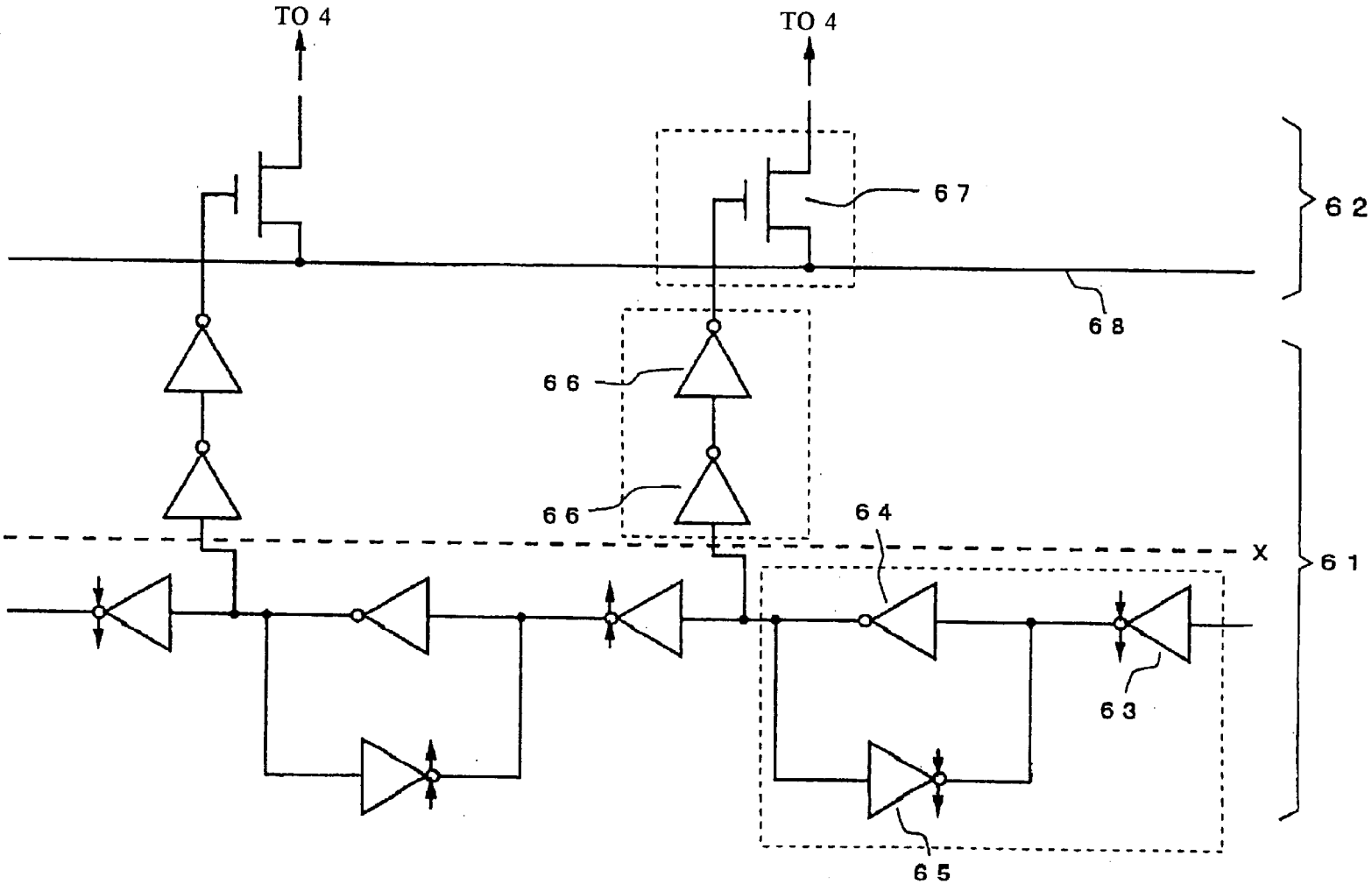
FIG. 3 is a partial equivalent circuit diagram of the liquid crystal display device according to the first embodiment.

FIG. 3 is an equivalent circuit diagram of the drain driver portion (the shift register 61 and the sampling portion 62). The lower half is the bidirectional horizontal shift register 61, and the upper half is the sampling portion 62. Respective phases of the horizontal shift register 61 comprise a first clocked inverter 63, an inverter 64, and a second clocked inverter 65 connected in parallel to the inverter 64 in an opposite direction. Output from the individual neighboring phase is sent to the sampling portion 62 through a buffer having a plurality of inverters 66 connected in series. The sampling portion 62 comprises an analog switch 67 having a gate connected to each corresponding phase of the buffer portion 66 and a video line 68 through which an original image signal is passed from outside. The analog switch 67 is connected to the video line 68 and controlled to switch on or off the output from each phase of the horizontal shift register 61, so that a display signal to be supplied from the original image signal to the respective pixels is sampled, outputted to the drain line DL of each corresponding column of the display area 4, and supplied to the pixel TFT SE of the same column.

In the present invention, a sealing material 3 is formed to partly cover the drain driver, particularly the horizontal shift register 61, and its edge line is linear on the horizontal shift register 61 as shown in FIG. 1. The horizontal shift register 61 has one shift register circuit formed to fully cover the transversal side of the display area 4 in the drawing or a plurality of shift register circuits connected in series formed to fully cover the transversal side of the display area 4. In any case, the sealing material 3 is formed to linearly cover the horizontal shift register 61 with respect to the same side. Therefore, even if the characteristics of the TFT elements just below the sealing material 3 were changed so to have different characteristics from those of the TFT elements in the other area, the phases of the horizontal shift register 61 are prevented from having different operating characteristics. Accordingly, areas having different displays in an inter-column direction are prevented from being present on the display area 4.

As to the gate driver side, the sealing material 33 is also formed to partly cover the vertical shift register 51 along the entire longitudinal side of the display area 4 and its edge line is linear on the vertical shift register 51. Therefore, even if the characteristics of the TFT elements just below the sealing material 3 were changed, operating characteristics are prevented from being changed among the phases of the vertical shift register 51, and areas having different displays in an inter-column direction are prevented from being present on the display area 4.

The sealing material 3 is formed to detour around the control circuit 7 in such a way that the control circuit 7 is prevented from being made defective and the operating directions of drivers 5, 6 can be changed freely.

Furthermore, since a curved part of the sealing material 3 is not on the drivers 5, 6 or the control circuit 7, influence to the display can be prevented, even if the curved part of the sealing material 3 suffers from a stress.

Figure 4:
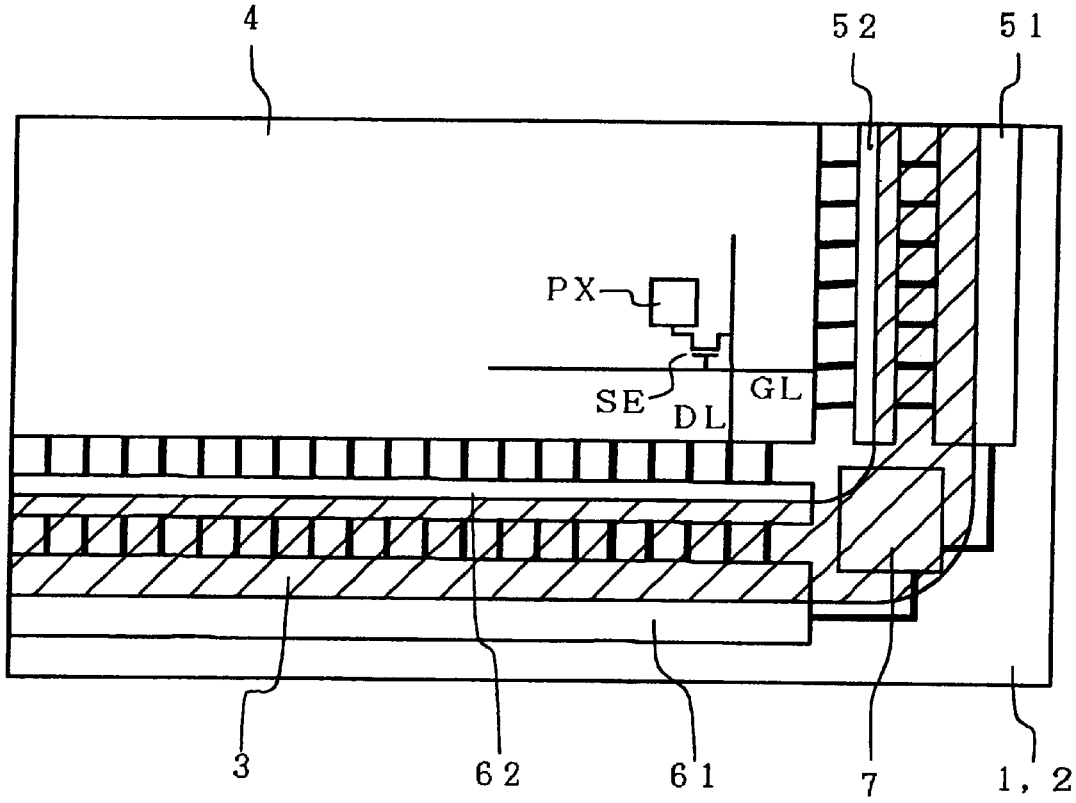
FIG. 4 is a partial plan view of a liquid crystal display device according to a second embodiment of the present invention.

FIG. 4 is a partial plan view of a liquid crystal display device according to a second embodiment of the present invention. In this embodiment, a sealing material 3 is formed to cover the drain driver comprising the horizontal shift register 61 and the sampling portion 62 with its overall width, and its edge lines are linear on the areas of drain driver (the shift register 61 and the sampling portion 62). Therefore, even if the TFT elements had different characteristics between the area just below the sealing material 3 and the other area, an operational difference is not caused among the phases of the drain driver (the shift register 61 and the sampling portion 62), and display is prevented from being varied among the phases of the display area 4.

Especially, in this embodiment, the outside edge line of the sealing material 3 in FIG. 4 is positioned between the shift register circuit portion (the first clocked inverter 63, the inverter 64 and the second clocked inverter 65) and the buffer portion 66 of the horizontal shift register 61 as indicated by line X in FIG. 3 in further detail. In other words, the buffer portion 66 is in the area just below the sealing material 3, and the shift register circuit portion (the first clocked inverter 63, the inverter 64 and the second clocked inverter 65) is outside of the sealing material 3. If a threshold voltage of the TFT elements just below the sealing material 3 is varied, the logical operation may be affected, but the buffer portion 66 is not affected by the change in threshold voltage as the shift register circuit portion (the first clocked inverter 63, while the inverter 64 and the second clocked inverter 65) is affected unless there is a difference among the phases. The sampling portion 62 is also little affected by the change in threshold voltage. Therefore, even if the sealing material 3 is formed to cover the drain driver (the shift register 61 and the sampling portion 62), when it is formed to detour around the shift register circuit portion (the first clocked inverter 63, the inverter 64 and the second clocked inverter 65), the shift register circuit portion (the first clocked inverter 63, the inverter 64 and the second clocked inverter 65) performs its normal logical operation, and a display signal having accurate amplitude is output at the buffer portion 66 and the sampling portion 62. Thus, the drain driver (the shift register 61 and the sampling portion 62) operates finely as the whole.

On the gate driver side, the sealing material 3 is formed to cover the gate driver, which comprises the vertical shift register 51 and the sampling portion 52, with its overall width, and its edge lines are linear on the gate driver (the shift register 51 and the sampling portion 52). Therefore, even if the TFT elements had different characteristics between the area just below the sealing material 3 and the other area, an operational difference is not caused among the phases, and display is prevented from being varied among the rows of the display area 4. Especially, the outside edge line of the sealing material 3 is positioned inside of the shift register circuit portion (the first clocked inverter 53, the inverter 54 and the second clocked inverter 55) as indicated by line X in FIG. 2. Therefore, the logical operation of the shift register (the first clocked inverter 53, the inverter 54 and the second clocked inverter 55) is prevented from being influenced by a change in threshold voltage of the TFT elements. Besides, stability is further enhanced by positioning the outer edge line of the sealing material 3 inside of the AND gate 56. The change in threshold voltage also does not cause any influence even if the sealing material 3 overlaps on the buffer portion 52.

Figure 5:
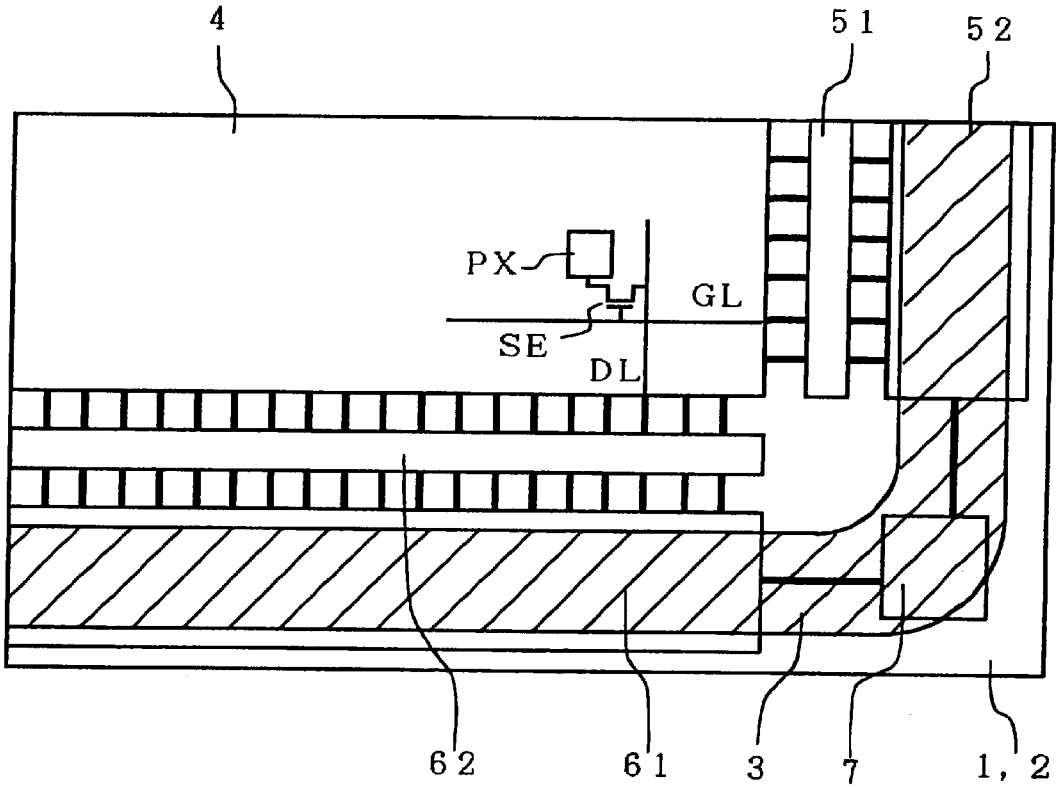
FIG. 5 is a partial plan view of a liquid crystal display device according to a third embodiment of the present invention.

FIG. 5 is a partial plan view of a liquid crystal display device according to a third embodiment of the present invention. In this embodiment, the sealing material 3 is formed to cover the drain driver, particularly its overall width is positioned on the horizontal shift register 61, and the edge lines of the sealing material 3 are linear on the horizontal shift register 61. On the gate driver side, the overall width of the sealing material 3 is positioned on the vertical shift register 51, and its edge lines are linear on the vertical shift register 51. Therefore, even if the TFT elements had different characteristics between the area just below the sealing material 3 and the other area, an operational difference is not caused among the phases, and display is prevented from being varied in the display area 4.

Figure 6:
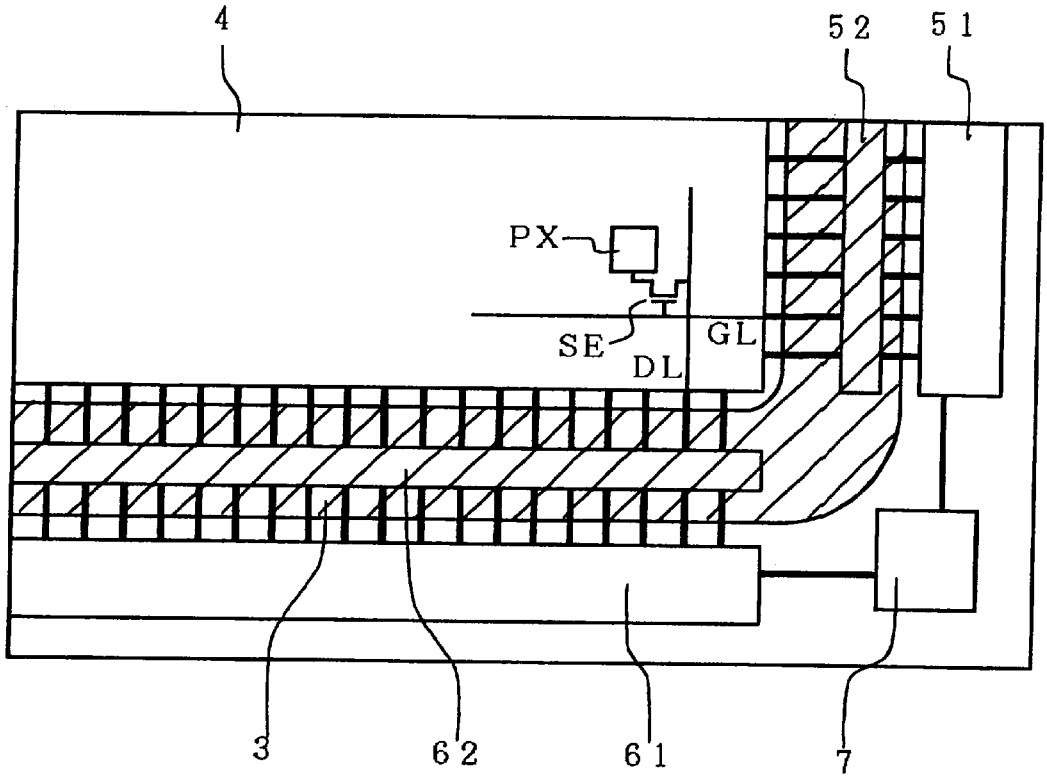
FIG. 6 is a partial plan view of a liquid crystal display device according to a fourth embodiment of the present invention.

FIG. 6 is a partial plan view of the liquid crystal display device according to a fourth embodiment of the invention. In this embodiment, the sealing material 3 is formed to cover the drain driver, and particularly positioned to fully cover the sampling portion 62. A change in threshold voltage does not affect sampling unless the analog switch 67 operates different among the phases, and display is prevented from varying among the columns. The sealing material 3 is also formed to fully cover the buffer portion 52 of the gate driver. A change in threshold voltage of the TFT components configuring the inverter 57 does not affect display.

Changeover operation of the driver is prevented from becoming defective because the sealing material 3 is formed to detour around the control circuit 7.

Figure 7:
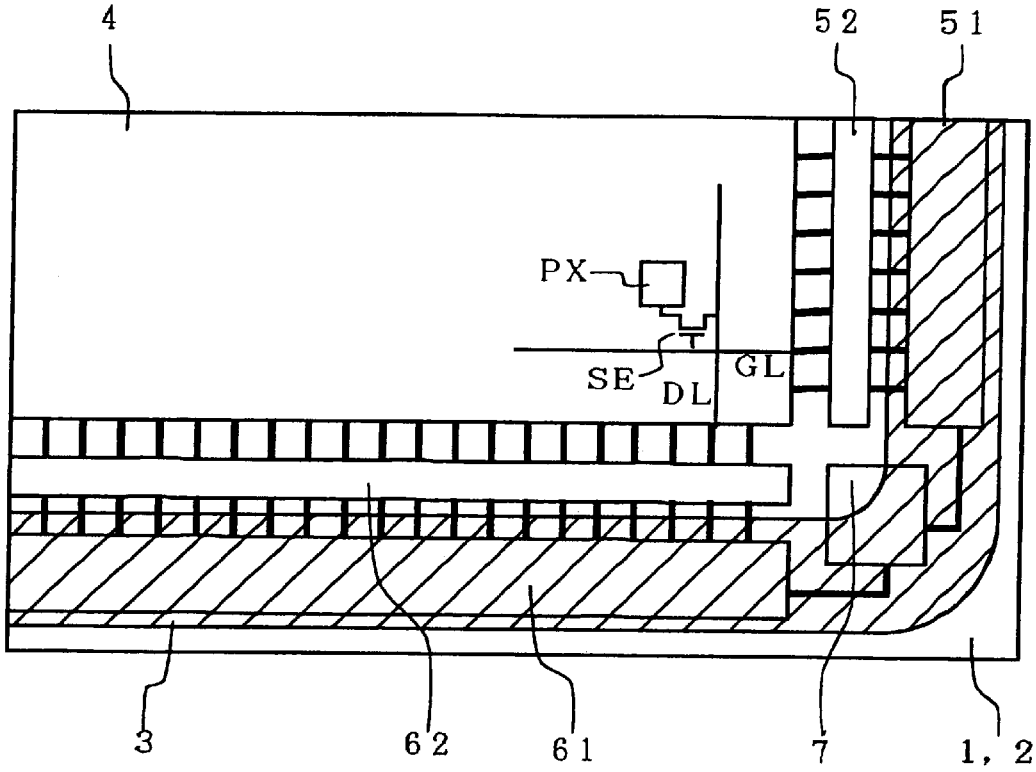
FIG. 7 is a partial plan view of a liquid crystal display device according to a fifth embodiment of the present invention.

FIG. 7 is a partial plan view of a liquid crystal display device according to a fifth embodiment of the present invention. In this embodiment, the sealing material 3 is formed to cover the drain driver but positioned to fully cover the horizontal shift register 61. Therefore, all the TFT elements in the horizontal shift register 61 are affected similarly by a change in threshold voltage, and operation does not change among the phases. As a result, areas having different displays are prevented from being present among the columns in the display area 4. On the gate driver side, the sealing material 3 is also formed to fully cover the vertical shift register 51, so that areas having different displays among the rows can be prevented from being present in the display area 4.

Figure 8:
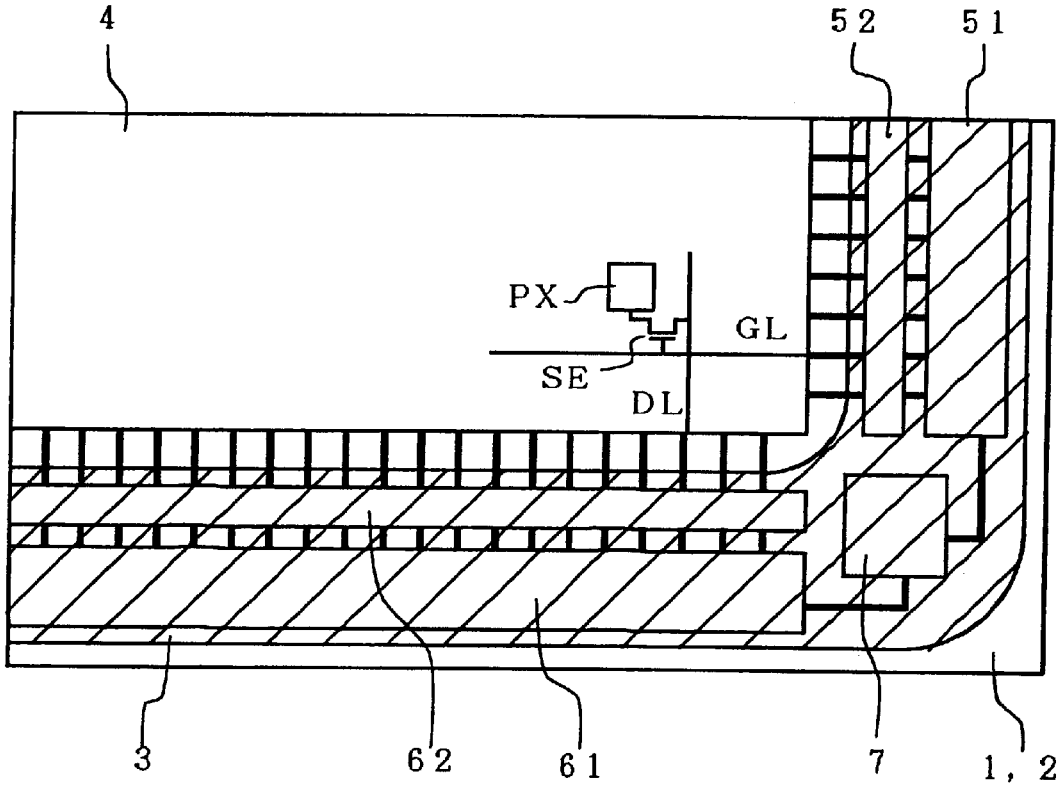
FIG. 8 is a partial plan view of a liquid crystal display device according to a sixth embodiment of the present invention.

FIG. 8 is a partial plan view of a liquid crystal display device according to a sixth embodiment of the present invention. In this embodiment, the sealing material 3 is formed to fully cover the drain driver which comprises the horizontal shift register 61 and the sampling portion 62. Therefore, all the TFT components in the drain driver (the shift register 61 and the sampling portion 62) are similarly affected by a change in threshold voltage, and no change is caused in operation among the phases. As a result, areas having different displays are prevented from being present among the columns in the display area 4. The sealing material 3 is also formed to fully cover the gate driver which comprises the vertical shift register 51 and the buffer portion 52. Therefore, all the TFT components in the gate driver (the shift register 51 and the buffer portion 52) are similarly affected by a change in threshold voltage, and operation does not change among the phases. As a result, areas having different displays among the rows are prevented from being present in the display area 4.

Figure 9:
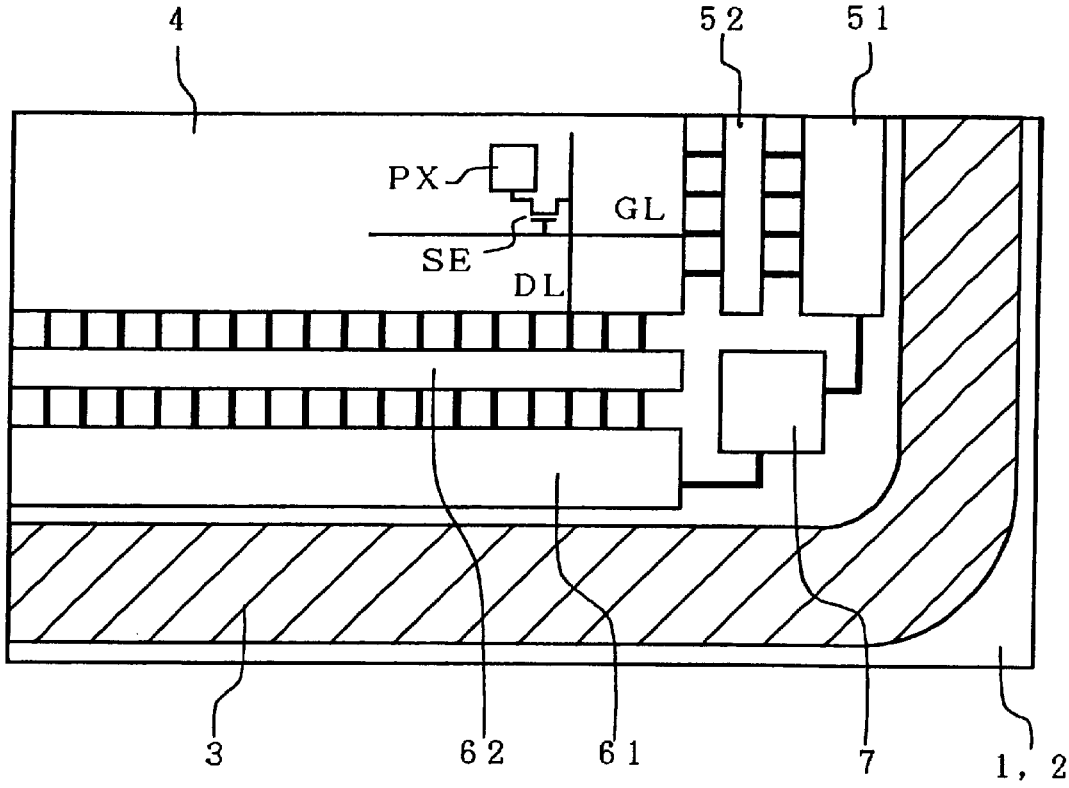
FIG. 9 is a partial plan view of a liquid crystal display device according to a seventh embodiment of the present invention.

FIG. 9 is a partial plan view of a liquid crystal display device according to a seventh embodiment of the present invention. In this embodiment, the sealing material 3 is formed to detour around the outside of the drain driver (the shift register 61 and the sampling portion 62) or the gate driver (the shift register 51 and the buffer portion 52), and a change in threshold voltage of the TFT components is not caused by the sealing material 3. Thus, an adverse effect on display can be prevented completely. Changeover in the operation direction of the driver is prevented from becoming inoperable because the sealing material 3 is formed to detour around the control circuit 7.

Figure 10:
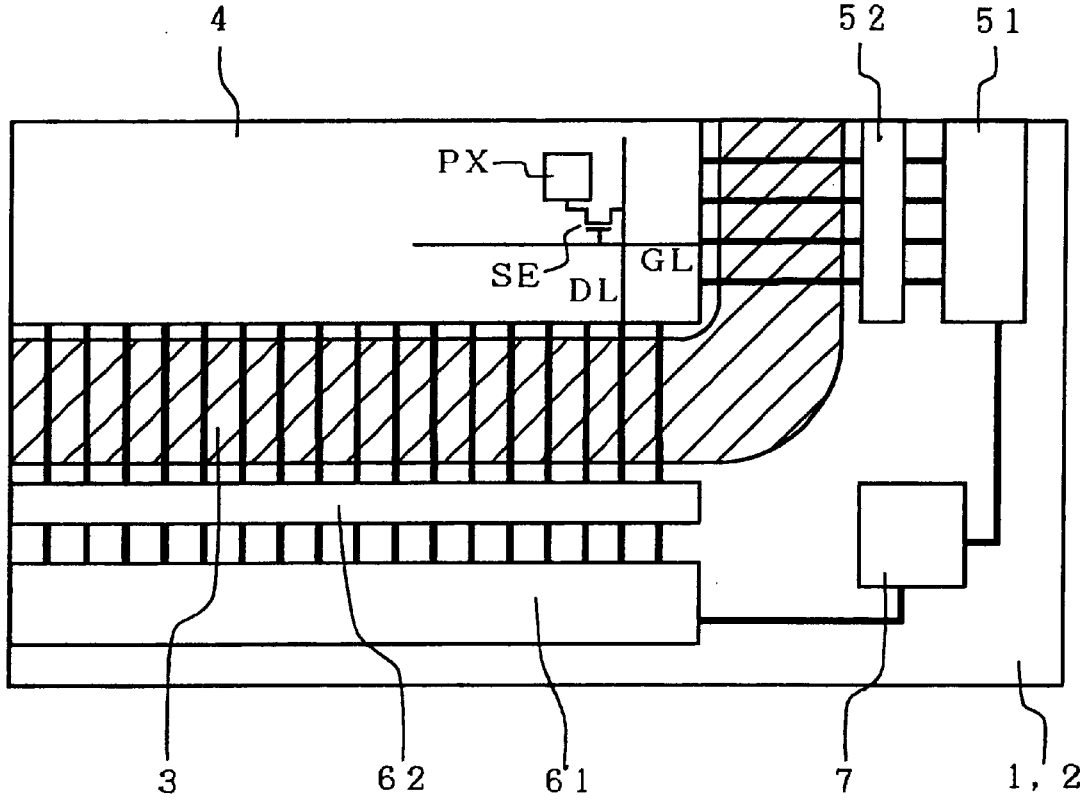
FIG. 10 is a partial plan view of a liquid crystal display device according to an eighth embodiment of the present invention.
Figure 11:
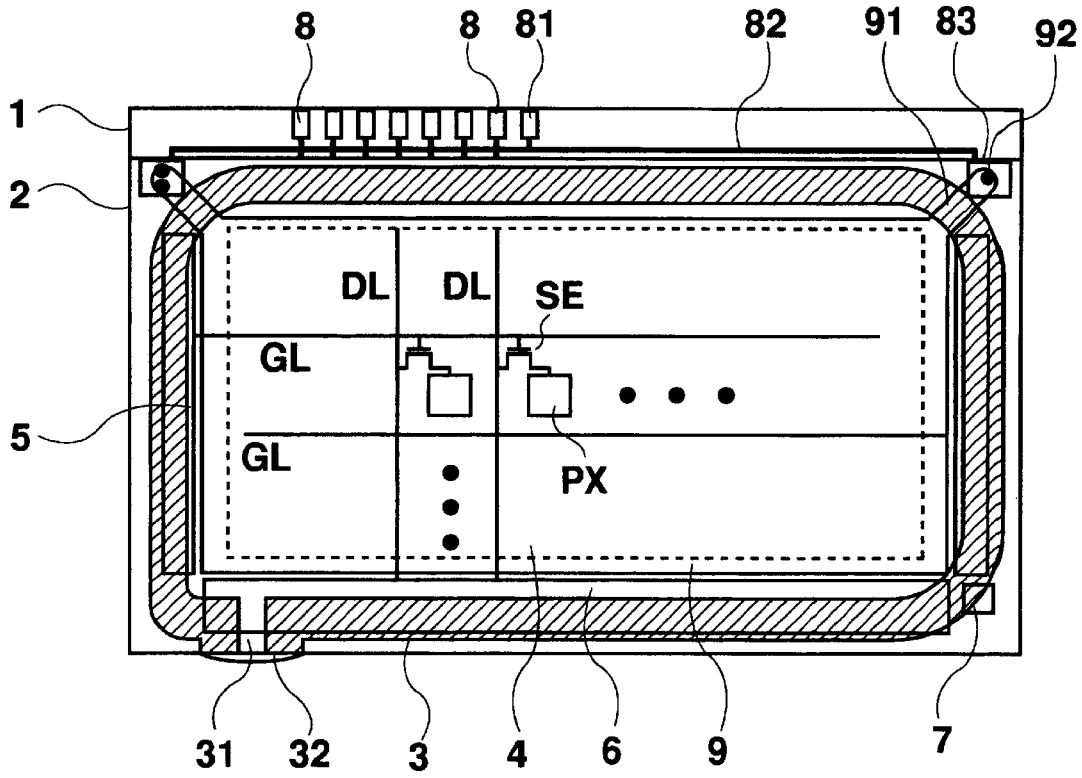
Fig. 11 PRIOR ART
FIG. 11 is a plan view of a conventional liquid crystal display device.
Figure 12:
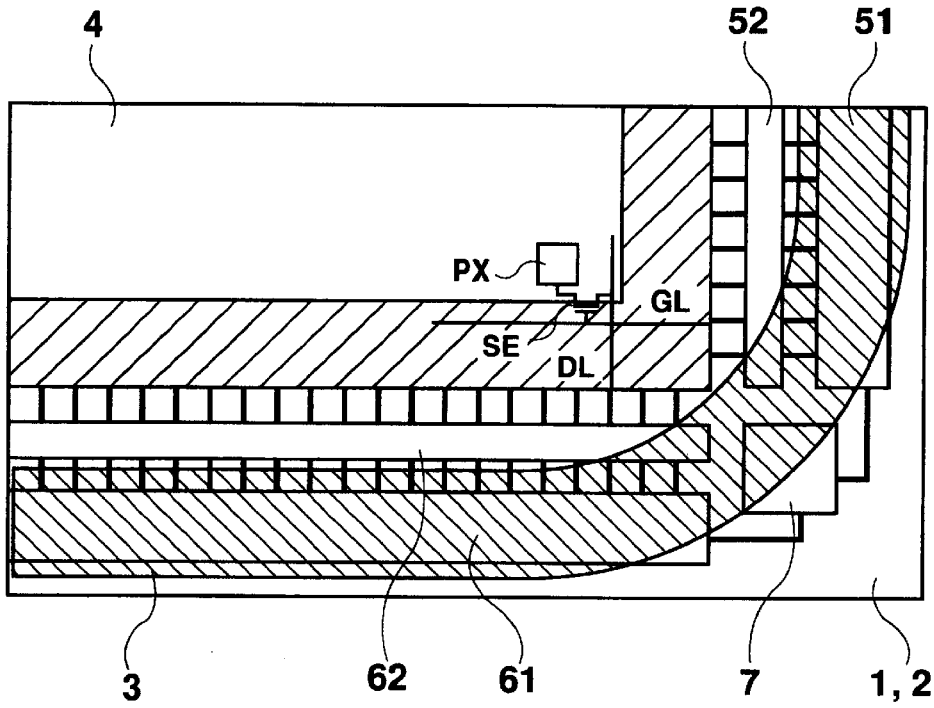
Fig. 12 PRIOR ART
FIG. 12 is a partial plan view of a conventional liquid crystal display device

FIG. 10 is a partial plan view of a liquid crystal display device according to an eighth embodiment of the present invention. In this embodiment, the sealing material 3 is formed to detour around the inside of the drain driver (the shift register 61 and the sampling portion 62) or the gate driver (the shift register 51 and the buffer portion 52), and a change in threshold voltage of the TFT components is not caused by the sealing material 3. An adverse effects on display can be completely prevented. Changeover in the operation direction of the driver is also prevented from becoming inoperable because the sealing material 3 is formed to detour around the control circuit 7.

While there have been described that what are at present considered to be preferred embodiments of the present invention, it is to be understood that various modifications may be made thereto, and it is intended that the appended claims cover all such modifications as fall within the true spirit and scope of the invention.

What is claimed is:

1. A display device, comprising:

a first substrate comprising a display area having a group of pixel electrodes arranged in a matrix and a group of first thin film transistors for supplying a display signal voltage to the respective pixel electrodes, a plurality of drive circuits comprising a group of second transistors arranged around the display area to drive the first thin film transistors, and a control circuit area for controlling the drive circuits;

a second substrate on which a common electrode is formed;

an adhesive agent for adhering the first and second substrates near their edges; and an optical material between the first and second substrates, wherein the adhesive agent is linearly formed on the drive circuits to extend its edge lines in a direction of the longitudinal sides of the drive circuits, and a lateral length of a region in each drive circuit that is covered by the adhesive agent is substantially constant in the drive circuit.

2. The display device according to claim 1, wherein the adhesive agent is formed to detour around the control circuit.

3. The display device according to claim 1, wherein the drive circuit comprises a drive signal output portion for outputting a drive signal based on the output from at least the shift register and each output phase of the shift register, and the adhesive agent is formed to detour around either of the shift register area and the drive signal output portion.

4. A display device, comprising:

a first substrate comprising a display area having a group of pixel electrodes arranged in a matrix and a group of first thin film transistors for supplying a display signal voltage to the respective pixel electrodes, a plurality of drive circuits comprising a group of second transistors arranged around the display area to drive the first thin film transistors, and a control circuit area for controlling the drive circuits;

a second substrate on which a common electrode is formed;

an adhesive agent for adhering the first and second substrates near their edges; and an optical material between the first and second substrates; wherein the adhesive agent is formed to detour around the drive circuits, the adhesive agent is provided on an area at an outer side of the drive circuits, the adhesive agent has edge lines which are not superimposed on outer edge lines of the drive circuits, and the edge lines are linearly formed to extend in a longitudinal direction of the drive circuits.

5. The display device according to claim 4, wherein the adhesive agent is formed to detour around the control circuit.

6. A display device, comprising:

a first substrate comprising a display area having a group of pixel electrodes arranged in a matrix and a group of first thin film transistors for supplying a display signal voltage to the respective pixel electrodes, a plurality of drive circuits comprising a group of second transistors arranged around the display area to drive the first thin film transistors, and a control circuit area for controlling the drive circuits;

a second substrate on which a common electrode is formed;

an adhesive agent for adhering the first and second substrates near their edges; and an optical material between the first and second substrates; wherein each of the drive circuits has a drive signal output portion for outputting a drive signal based on the output from a shift register, the adhesive agent is formed to fully cover either the shift register or the drive signal output portion, the adhesive agent has edge lines which are linearly formed to extend in the longitudinal direction of the drive circuits, and the edge lines of the adhesive agent are not superimposed on outer edges of the drive circuits.

7. The display device according to claim 6, wherein the adhesive agent is formed to fully cover at least either of the shift register area and the drive signal output portion and to detour around the other.

8. The display device according to claim 6, wherein the adhesive agent is formed to fully cover both the shift register area and the drive signal output portion.

9. A display device, comprising:

a first substrate comprising a display area having a group of pixel electrodes arranged in a matrix and a group of first thin film transistors for supplying a display signal voltage to the respective pixel electrodes, a plurality of drive circuits comprising a second group of transistors having a plurality of second transistors arranged around the display area to drive the first thin film transistors, and a control circuit area for controlling the drive circuits;

a second substrate on which a common electrode is formed;

an adhesive agent for adhering the first and second substrates near their edges; and an optical material between the first and second substrates, wherein the adhesive agent is formed to detour around the plurality of second transistors, and the adhesive agent has edge lines which are linearly formed to extend in a longitudinal direction of the drive circuits.

10. A display device, comprising:

a first substrate comprising a display area having a group of pixel electrodes arranged in a matrix and a group of first thin film transistors for supplying a display signal voltage to the respective pixel electrodes, a plurality of drive circuits comprising a group of second transistors arranged around the display area to drive the first thin film transistors, and a control circuit area for controlling the drive circuits;

a second substrate on which a common electrode is formed;

an adhesive agent for adhering the first and second substrates near their edges; and an optical material between the first and second substrates, wherein the adhesive agent is formed on the substrate only at an inner side area of the drive circuit area so as to detour around the drive circuits and the control circuit area.

11. A display device, comprising:

a first substrate comprising a display area having a group of pixel electrodes arranged in a matrix and a group of first thin film transistors for supplying a display signal voltage to the respective pixel electrodes, and a plurality of drive circuit areas comprising a group of second transistors arranged around the display area to drive the first thin film transistors;

a second substrate on which a common electrode is formed;

an adhesive agent for adhering the first and second substrates along their edges; and an optical material between the first and second substrates; wherein the drive circuits includes a shift register comprising a shift register circuit section and a buffer section, and the adhesive agent is formed such that its edge line is positioned between the shift register circuit section and the buffer section.

12. A display device as defined in claim 11, wherein the first substrate includes a control circuit area for controlling the drive circuits.

13. A display device as defined in claim 12, wherein the adhesive agent is linearly formed to extends its edge line in a direction of the longitudinal sides of the drive circuits.

14. A display device as defined in claim 13, wherein the adhesive agent is formed to detour around the control circuit.

15. A display device as defined in claim 14, wherein the drive circuit comprises a drive signal output portion for outputting a drive signal based on the output from at least the shift register and each output phase of the shift register, and the adhesive agent is formed to detour around the shift register area and/or the control circuit area.

16. A display device as defined in claim 13, wherein the drive circuit comprises a drive signal output portion for outputting a drive signal based on the output from at least the shift register and each output phase of the shift register, and the adhesive agent is formed to detour around the shift register area and/or the control circuit area.

17. A display device as defined in claim 12, wherein the adhesive agent is formed to detour around the control circuit.

18. A display device as defined in claim 17, wherein the drive circuit comprises a drive signal output portion for outputting a drive signal based on the output from at least the shift register and each output phase of the shift register, and the adhesive agent is formed to detour around the shift register area and/or the control circuit area.

19. A display device as defined in claim 12, wherein the drive circuit comprises a drive signal output portion for outputting a drive signal based on the output from at least the shift register and each output phase of the shift register, and the adhesive agent is formed to detour around the shift register area and/or the control circuit area.

20. A display device as defined in claim 11, wherein the adhesive agent is linearly formed to extend its edge line in a direction of the longitudinal sides of the drive circuits.

21. A display device as defined in claim 20, wherein the adhesive agent is formed to detour around the control circuit.

22. A display device as defined in claim 21, wherein the drive circuit comprises a drive signal output portion for outputting a drive signal based on the output from at least the shift register and each output phase of the shift register, and the adhesive agent is formed to detour around the shift register area and/or the control circuit area.

23. A display device as defined in claim 20, wherein the drive circuit comprises a drive signal output portion for outputting a drive signal based on the output from at least the shift register and each output phase of the shift register, and the adhesive agent is formed to detour around the shift register area and/or the control circuit area.

24. A display device as defined in claim 11, wherein the adhesive agent is formed to detour around the control circuit.

25. A display device as defined in claim 24, wherein the drive circuit comprises a drive signal output portion for outputting a drive signal based on the output from at least the shift register and each output phase of the shift register, and the adhesive agent is formed to detour around the shift register area and/or the control circuit area.

26. A display device as defined in claim 11, wherein the drive circuit comprises a drive signal output portion for outputting a drive signal based on the output from at least the shift register and each output phase of the shift register, and the adhesive agent is formed to detour around the shift register area and/or the control circuit area.

27. A display device as defined in claim 26, wherein the drive circuit comprises a drive signal output portion for outputting a drive signal based on the output from at least the shift register and each output phase of the shift register, and the adhesive agent is formed to detour around the shift register area and/or the control circuit area.

* * * * *